US005954214A

United States Patent [19]

Guezennec et al.

[11] Patent Number: 5,954,214

[45] **Date of Patent: *Sep. 21, 1999**

[54] CAP FOR VACUUM CONTAINER HAVING DOUBLE FRANGIBLE SEAL AND CONTAINER HAVING SUCH A CAP

[75] Inventors: Roland Guezennec; Jean-Pierre Lhommond, both of Marmande; Jean-Francois Bardou, Sainte Bazeille, all of France

[73] Assignee: Optimal Food Processing Research Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,581

[22] Filed: May 28, 1997

[51] Int. Cl.[6] ..... B65D 51/16

[52] U.S. Cl. ..... 215/262; 215/232; 215/270; 215/310; 220/231; 220/288; 220/359.3; 220/367.1; 220/203.06; 220/203.08

[58] Field of Search ..... 215/246, 260, 215/270, 310, 311, 232, 262, 261, 249; 220/203.05, 203.08, 203.06, 203.11, 203.16, 231, 288, 367.1, 913, 359, 270, 359.3; 426/131, 118

[56] References Cited

U.S. PATENT DOCUMENTS

| | | | |
|---|---|---|---|
| 1,707,837 | 4/1929 | Wright . | |
| 1,773,311 | 8/1930 | Killen . | |
| 1,808,702 | 6/1931 | Williams . | |
| 2,286,999 | 6/1942 | Smith, Jr. . | |
| 2,890,810 | 6/1959 | Rohling | 220/231 |
| 3,013,687 | 12/1961 | Gould | 215/249 |
| 3,088,615 | 5/1963 | Mumford et al. | 215/249 |
| 3,371,811 | 3/1968 | McKnight . | |
| 3,410,436 | 11/1968 | Foss et al. . | |
| 3,462,037 | 8/1969 | Keller . | |
| 3,578,467 | 5/1971 | Huber | 220/231 X |
| 3,659,739 | 5/1972 | Luviano et al. | 220/367.1 X |
| 3,987,209 | 10/1976 | Gatineau et al. . | |
| 4,003,489 | 1/1977 | Bingaman | 215/560 |
| 4,051,973 | 10/1977 | Botkin | 426/131 X |
| 4,397,401 | 8/1983 | Ueno et al. | 220/359 X |
| 4,398,491 | 8/1983 | Fridl et al. . | |
| 4,400,401 | 8/1983 | Beauvais et al. . | |
| 4,500,011 | 2/1985 | Brochman | 220/359.3 |
| 4,689,936 | 9/1987 | Gaikema et al. . | |
| 4,883,198 | 11/1989 | Manska . | |
| 5,016,770 | 5/1991 | Rizzardi | 215/249 |
| 5,452,849 | 9/1995 | Schramer et al. | 220/270 X |
| 5,555,988 | 9/1996 | Koch et al. | 215/249 |
| 5,634,567 | 6/1997 | Hekal | 215/232 X |
| 5,688,544 | 11/1997 | Bolton et al. | 220/203.16 X |

FOREIGN PATENT DOCUMENTS

| | | | |
|---|---|---|---|
| 21042 | 1/1935 | Australia | 215/262 |
| 2395911 | 3/1979 | France | 215/249 |
| 655395 | 5/1936 | Germany . | |
| 879643 | 6/1953 | Germany | 215/262 |
| 1782395 | 8/1972 | Germany . | |
| 7737602 | 3/1978 | Germany . | |
| 73185 | 5/1916 | Switzerland | 215/262 |
| 402480 | 12/1933 | United Kingdom . | |
| 473723 | 10/1937 | United Kingdom | 215/262 |
| 1409348 | 10/1975 | United Kingdom | 215/249 |
| 2 274 278 | 7/1994 | United Kingdom . | |

*Primary Examiner*—Stephen K. Cronin
*Assistant Examiner*—Robin A. Hylton
*Attorney, Agent, or Firm*—Seidel Gonda Lavorgna & Monaco

[57] ABSTRACT

A hermetic cap for a container containing product packed in said container under vacuum. The cap has an orifice through it and a first frangible seal hermetically sealing the orifice on one surface of the cap and a second frangible seal hermetically sealing the orifice on an opposite surface of the cap.

15 Claims, 4 Drawing Sheets

CAP FOR VACUUM CONTAINER HAVING DOUBLE FRANGIBLE SEAL AND CONTAINER HAVING SUCH A CAP

FIELD OF THE INVENTION

The present invention pertains to an improved cap for foodstuffs and comestibles vacuum-packaged in rigid containers for preservation and storage.

BACKGROUND OF THE INVENTION

Canning or otherwise packaging foods to preserve and store them for long periods of time has been an important part of food processing since the eighteenth century, when a Parisian chef named Appert devised a crude method of canning. Appert's process was introduced into the United States through England in about 1818. Canning remained an inexact process until Louis Pasteur applied his principles of fermentation to it in 1895.

Today, from picking to packaging, canning is a highly-developed, scientific industry. Foodstuffs are packaged in many different types of containers, with metal cans, glass jars and plastic packages being used on a wide scale. For convenience, the packaging of foodstuffs in rigid containers (i.e., cans, jars and rigid plastic packages) will be referred to collectively herein as "canning." No matter what type of container is used, however, all canning processes must deal with the sensitivity of most foods to oxygen. As anyone who has sliced a fresh apple knows, oxygen in the air immediately begins to react with fresh foods and leads to the loss of their organoleptic qualities and to their rapid spoilage. All foods are sensitive to oxygen in varying degrees, and the successful preservation of foods by canning requires, as an important step, the elimination of oxygen and other gases from the containers.

However, the containers themselves may be difficult to open after processing, because of the high degree of vacuum inside them. In particular, when the containers are screw-top jars, consumers often have great difficulty in unscrewing the caps. Moreover, this problem is not unique to the disclosed process, but occurs in other vacuum packaging processes as well. This problem has led to a proliferation of tools, devices, and "gadgets" to open tightly sealed screw-on caps. Thus, there is a need for a cap, in particular but not necessarily a screw-on cap, which maintains a hermetic seal to maintain a high vacuum, but which can be opened easily, without the need for special tools.

SUMMARY OF THE INVENTION

The present invention is directed to a hermetic cap for a container containing product packed in said container under vacuum. The cap has an orifice therethrough and a first frangible seal hermetically sealing the orifice on one surface of the cap and a second frangible seal hermetically sealing the orifice on an opposite surface of the cap.

The present invention includes a method of making a hermetic cap for a container containing product packed in said container under vacuum. The method of the invention comprises the steps of forming the cap to a desired shape, forming an orifice through the cap at a desired location, providing a first frangible seal on one surface of the cap to hermetically seal the orifice, and providing a second frangible seal on an opposite surface of the cap to hermetically seal the orifice.

A third aspect of the invention is directed to a container for containing foodstuffs packaged under vacuum and hermetically sealed. The container comprises a jar having a mouth with screw threads around the perimeter of the mouth and a screw-on cap which seals the jar. The cap has an orifice through it and has screw threads around the perimeter of the cap which engage said screw threads on the perimeter of the mouth of the jar. The cap further includes a first frangible seal on one side of said cap and a second frangible seal on an opposite side of said cap, the first and second frangible seals fully covering the orifice and maintaining the hermetic seal until such time as the seals are ruptured by forces external to the container.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
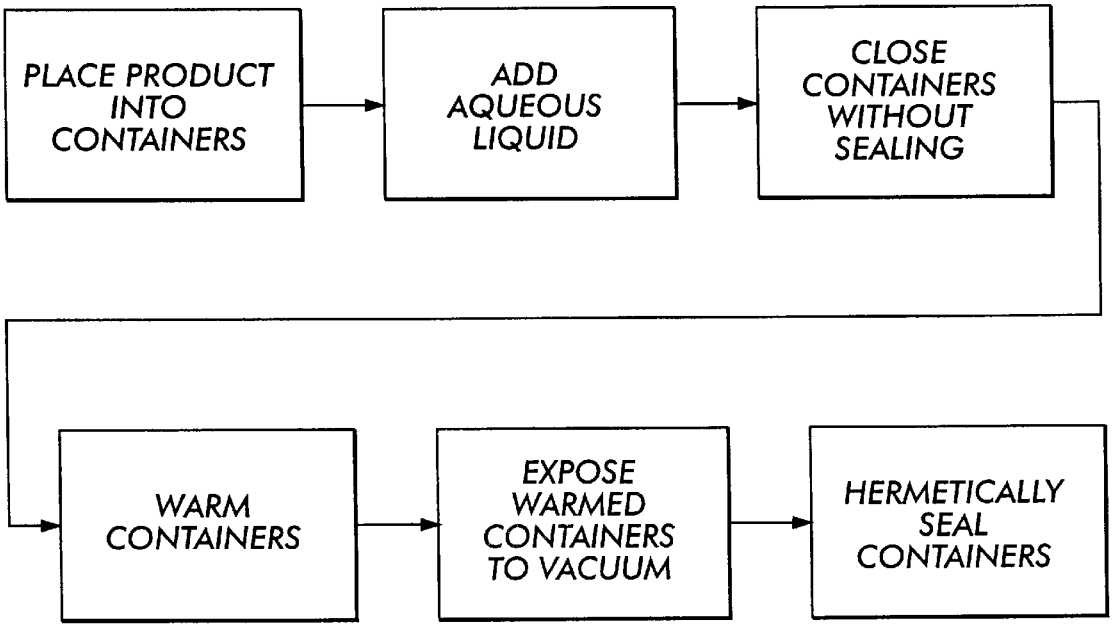
FIG. 1 is a simplified block diagram illustrating the steps of a food packaging process in which a cap according to the present invention may be used.

Referring now to the drawings, the process according to the block diagram of FIG. 1 will now be described. Foodstuffs and comestibles to be packaged are first obtained and prepared according to conventional techniques. (As used herein, "packaged" or "packaging" means packaging foodstuffs in glass jars or any other suitable containers which are then sealed with a cap.) Thus, for example, fresh vegetables are washed and cleaned, cut into pieces if desired, have leaves and stems removed as required, and so forth. Although the process of FIG. 1 is particularly useful in the packaging of vegetables, it is not limited to the packaging of vegetables but is applicable to the packaging of fruits, mushrooms, vegetable-based dishes, ready-made dishes based on meats, poultry and fish, and is also applicable to liquid products such as fruit juices and soup. These will be referred to herein collectively as "products" or "foodstuffs."

After the foodstuff to be packaged has been prepared as desired, it is placed in the desired containers. Preferably, such containers comprise glass jars, but other rigid containers, such as metal cans or substantially rigid plastic containers, may be used.

After the foodstuff has been placed in the containers, a small amount of aqueous liquid is added to the containers. The amount of liquid required is an amount which, when brought to a boil, is sufficient generate a volume of vapor approximately ten times, or more, the volume of the container. A recommended amount is an amount sufficient to generate a volume approximately fifty times the volume of the container. In accordance with the process of FIG. 1, enough liquid is used to generate the desired amount of vapor while leaving a small amount of liquid not converted to vapor and remaining in the container as liquid. Preferably, the amount of liquid added is approximately five percent by volume of the container, as it has been found that this amount of liquid is enough to generate the desired volume of vapor and leave a small amount in the container as liquid. The small amount of liquid left in the container will facilitate heat transfer during subsequent processing. The aqueous liquid may be water, brine, syrup, or other suitable packaging liquid.

After adding the liquid to the containers, the containers are closed without sealing them. For example, if the containers comprise glass jars, the jars may be capped with standard "60 degree" screw-top caps. It is important to note that, at this step, after the containers are capped they are not sealed, so that the interior of the containers is in communication with the ambient atmosphere. Alternatively, it is within the process of FIG. 1 to close the containers tightly, but not seal them, so that they are not in communication with the ambient atmosphere, and then partially open them during the vacuum exposure step, to be described below, so that the interior of the containers will be in communication with the vacuum after partial opening.

The closed but unsealed containers then enter the warming, or preheating, phase of the process. The containers and their contents are warmed to a temperature well below 100° C., so that no cooking of the foodstuff occurs during warming. The exact temperature to which the containers are warmed is not critical, as long as the temperature is sufficient to cause the liquid in the containers to boil when they are subjected to subatmospheric pressure, as will be described below. A typical temperature is 60° C., which is sufficient to cause water to boil at a subatmospheric pressure of 0.2 bars absolute. (One bar is approximately equal to one atmosphere of pressure.) The precise way in which the containers may be warmed is likewise not vital to the process, and the preheating may be carried out by any heating method or apparatus able to maintain the desired temperature to within ten percent.

After being warmed to the desired temperature, the containers are exposed to a subatmospheric pressure or vacuum. One way of achieving this is to introduce the containers into a vacuum chamber within which a constant subatmospheric pressure or vacuum is maintained via mechanical or thermodynamic pumping. The subatmospheric pressure is chosen in conjunction with the desired temperature so that when the containers are exposed to the subatmospheric pressure, the preheated liquid will come to a boil. As noted above, the containers, while closed, are either open to the ambient low pressure or are partially opened inside the vacuum chamber so that the interior of the containers is open to the vacuum.

While the containers are still at the preheating temperature and subatmospheric pressure, the containers are hermetically sealed, thus sealing in the ambient water vapor environment within the container. The sealing operation used is chosen to accommodate the type of container used, such as a conventional cap-screwing device for glass jars.

Following sealing, the sealed containers exit the vacuum chamber and are ready for further processing if desired.

Figure 2:
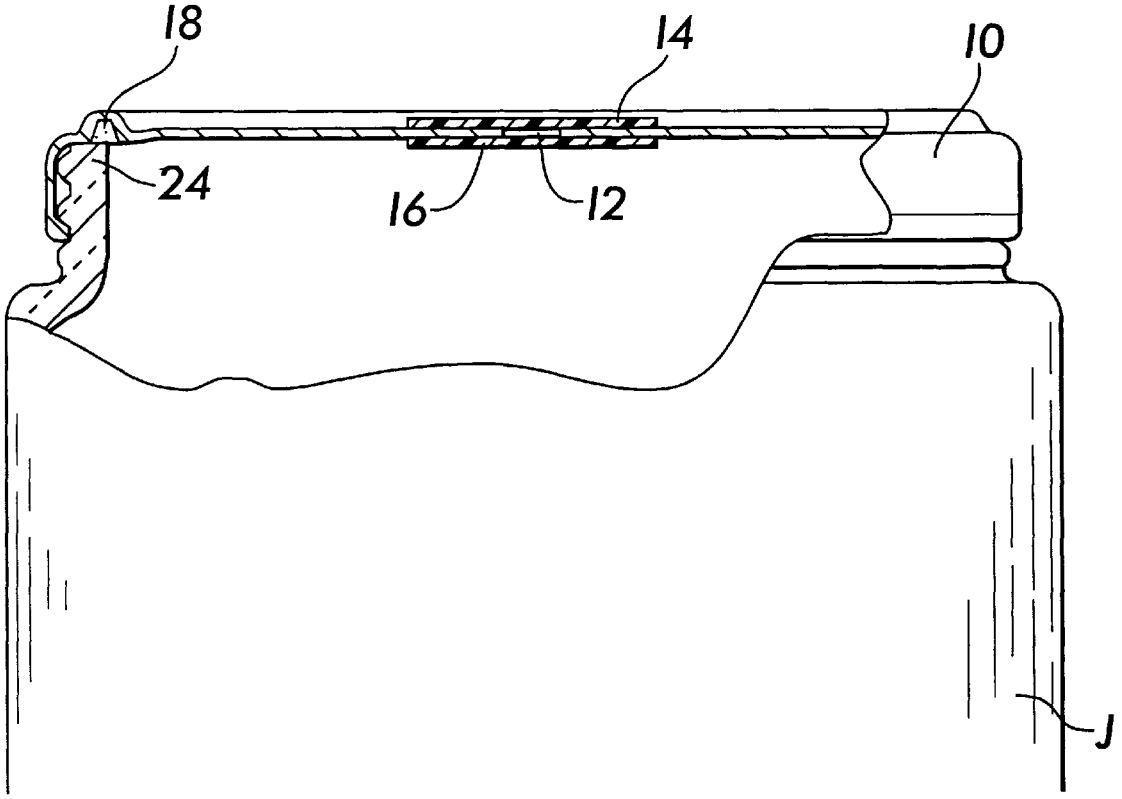
FIG. 2 is a sectional view showing the orifice and frangible seals of a cap according to one embodiment of the present invention.

Because the jars are sealed under conditions of such high vacuum, the jars will be very difficult to open by the ultimate consumer. The present invention contemplates a cap which the ultimate consumer to easily open a jar processed by the process of FIG. 1, or any other process which results in a high degree of vacuum inside the container. Referring to FIG. 2, there is shown a cap 10 according to the present invention. As illustrated in FIG. 2, the cap 10 is a screw-on cap, but it should be understood that while the present invention finds particular utility in the context of a screw-on cap, it is not so limited, and the present invention can be used on all kinds of caps or other container closures. It will be seen from FIG. 2 that the cap 10 is provided with an orifice 12 therethrough. Orifice 12 is small enough that it does not affect the cap's mechanical properties, such as its mechanical strength and rigidity. It is believed that a circular orifice having a diameter of about 5 mm is sufficient.

Prior to placing cap 10 on a jar J orifice 12 is sealed with a seal membrane 14 on the outside surface of cap 10. Membrane 14 is made of a material which is impervious to gases, particularly oxygen, and which does not give off any chemical substances which could adversely affect the contents of the jar. The membrane 14 must also be capable of withstanding processing temperatures up to 140° C. to which the cap might be exposed, and must also be capable of withstanding pressure differentials of up to 1.5 Bars across the membrane. Finally, the membrane must be frangible, and easily ruptured by a sharp object or torn by hand when it is desired to break the seal and equalize the pressure inside the jar just prior to opening it. A suitable material for membrane 14 is a vacuum-metallized polyester film, having aluminum metallization of a thickness of about 36 microns. Membrane 14 may be fastened to cap 10 using an acrylic glue, such as D500 permanent or equivalent. A second membrane 16, of like construction to membrane 14, is attached to the inside surface of cap 10, using an acrylic adhesive in like manner.

Prior to attaching the frangible seals 14 and 16, a sealing compound 18 is placed around the perimeter of the inside surface of cap 10 in the area of the lip 24 of jar J, in known manner. The sealing compound may be a PVC compound, such as is known in the art, and the cap 10 and the sealing compound 18 are subjected to a temperature of about 200° C. for about one minute to polymerize the sealing compound 18.

The membrane seals 14 and 16 permit the jar to retain intact its original factory hermetic seal regardless of the presence of orifice 12 in cap 10, and permits the vacuum present in the jar after hermetic sealing to be relieved by the ultimate consumer just prior to opening the jar by breaking the frangible membrane seals 14 and 16, such as by puncturing the seals with the tines of a fork or the point of a knife, so that opening is facilitated.

Figure 3:
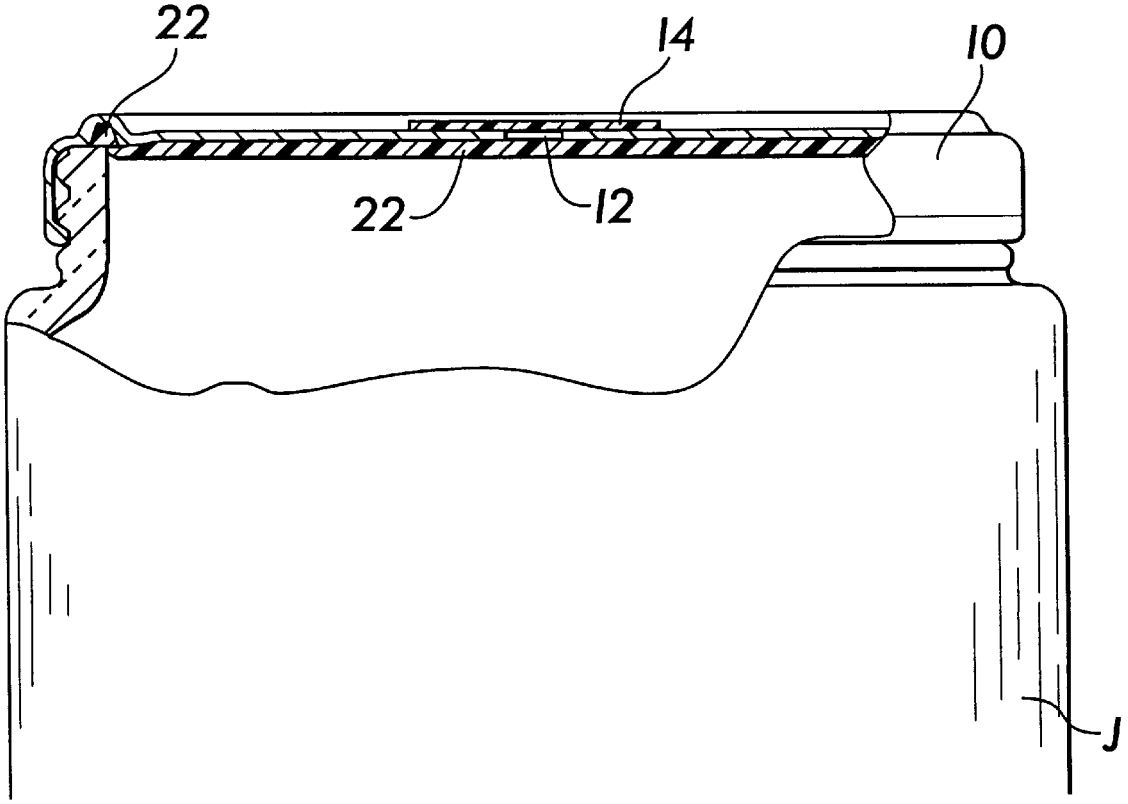
FIG. 3 is a sectional view showing the orifice and frangible seals of a cap according to a second embodiment of the present invention.
Figure 4:
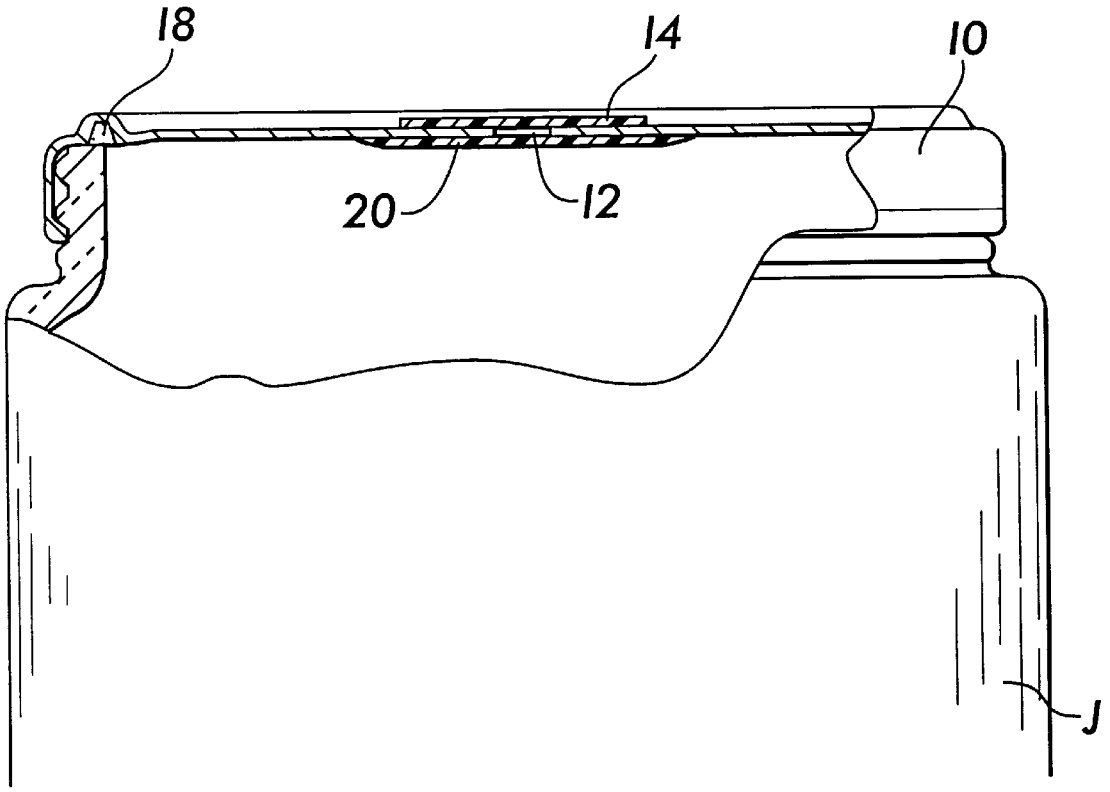
FIG. 4 a sectional view showing the orifice and frangible seals of a cap according to a third embodiment of the present invention.

Alternative embodiments of the cap with the frangible seal are illustrated in FIGS. 3 and 4. In FIG. 4, orifice 12 is sealed with a seal membrane 14 on the outside surface of cap 10, as in the embodiment of FIG. 2. However, instead of a second seal membrane 16, the inner surface of cap 10 in the area of orifice 12 is covered with a PVC compound 20, which may, but need not, be the same PVC compound as sealing compound 18 around the perimeter of the inside surface of cap 10. In FIG. 3, orifice 12 is sealed with a seal membrane 14 on the outside surface of cap 10, as in the previous two embodiments, and the entire inner surface of cap 10 in the area of orifice 12 is covered with a PVC compound 22, which forms an inner seal and seals the perimeter of the inside surface of cap 10 against the lip 24 of jar J. In both these embodiments, the PVC compound is polymerized at about 200° C. for about a minute, after the seal membrane 14 is attached to the outer surface of the cap. In addition, in both these embodiments the inner seals formed by the PVC compound are frangible and may be broken by piercing them with a sharp object such as the tines of a fork or the point of a knife.

Seals made according to the present invention are able to maintain a pressure difference of 1.5 Bar from inside jar J to the outside (atmosphere), and are able to withstand process temperatures of up to 140° C.

In addition to providing a cap which is easy to open, the present invention also makes it convenient to warm the product packaged in the container without having to completely remove the cap, or otherwise open the container. Breaking the frangible seals 14 and 16 permits any steam pressure inside the container which is generated on warming to vent to atmosphere, avoiding a burst container. This is especially valuable when glass containers are used, in that it avoids the risk of an exploding container and the resulting danger of broken glass. At the same time, the cap limits the outflow of steam generated on warming, so that it is possible to warm the food product in conditions of saturated vapor, thereby avoiding dehydration of the product, which would certainly occur is the container were completely open.

The present invention may be embodied in other specific forms without departing from the spirit or essential attributes thereof and, accordingly, reference should be made to the appended claims, rather than to the foregoing specification, as indicating the scope of the invention.

We claim:

1. A hermetic cap for a container containing product packed in said container under vacuum, the cap comprising an orifice therethrough and a first frangible seal sealingly attached to the cap on only one surface thereof and hermetically sealing the orifice on said one surface of the cap and a separate second frangible seal sealingly attached to the cap on only an opposite surface thereof and hermetically sealing the orifice said opposite surface of the cap, the first frangible seal being not directly attached to the second frangible seal.

2. A hermetic cap according to claim 1, wherein the first and second frangible seals comprise a polymer film membrane.

3. A hermetic cap according to claim 2, wherein the polymer film is a polyester film.

4. A hermetic cap according to claim 1, wherein the first frangible seal comprises a polymer film membrane and the second frangible seal comprises a non-film polymer material.

5. A hermetic cap according to claim 4, wherein the non-film polymer material is located in the area of the cap immediately surrounding said orifice.

6. A hermetic cap according to claim 4, wherein the non-film polymer material covers substantially the entire inner surface of the cap.

7. A hermetic cap according to claim 1, wherein the cap is a screw-on cap.

8. A container for containing foodstuffs packaged under vacuum and hermetically sealed, comprising:

a jar having a mouth with screw threads around the perimeter of the mouth;

a screw-on cap sealing said jar, said cap having an orifice therethrough and having screw threads around the perimeter of the cap which engage said screw threads on the perimeter of the mouth of said jar; and a first frangible seal on only one side of said cap and a separate second frangible seal on only an opposite side of said cap, said first and second frangible seals fully covering said orifice and maintaining the hermetic seal until such time as the seals are ruptured by forces external to the container, the first frangible seal being not directly attached to the second frangible seal and each of the first and second frangible seals being sealingly attached to the cap.

9. A container as in claim 8, wherein said jar is made of glass.

10. A container for containing foodstuffs packaged by a process wherein a desired quantity of foodstuff to be packaged is placed in the container, a quantity of liquid is added, the container and its contents are warmed to a temperature sufficient to vaporize said liquid upon exposure to a pressure lower than atmospheric pressure, and the warmed container is exposed to a sub-atmospheric pressure, comprising:

a jar having a mouth with screw threads around the perimeter of the mouth;

a screw-on cap for closing said jar after said quantity of liquid is added and for sealing said jar after the warmed container is exposed to said sub-atmospheric pressure, said cap having an orifice therethrough and having screw threads around the perimeter of the cap which engage said screw threads on the perimeter of the mouth of said jar; and a first frangible seal on only one side of said cap and a separate second frangible seal on only an opposite side of said cap, said first and second frangible seals fully covering said orifice, the first frangible seal being not directly attached to the second frangible seal and each of the first and second frangible seals being sealingly attached to the cap.

11. A hermetic cap for a container containing product packed in said container under vacuum, the cap comprising an orifice therethrough and a first frangible seal hermetically sealing the orifice on only one surface of the cap and a separate second frangible seal hermetically sealing the orifice on only an opposite surface of the cap, the first frangible seal being not directly attached to the second frangible seal, wherein the first and second frangible seals comprise a polymer film membrane.

12. A hermetic cap according to claim 11, wherein the polymer film is a polyester film.

13. A hermetic cap for a container containing product packed in said container under vacuum, the cap comprising an orifice therethrough and a first frangible seal hermetically sealing the orifice on only one surface of the cap and a separate second frangible seal hermetically sealing the orifice on only an opposite surface of the cap, the first frangible seal being not directly attached to the second frangible seal, and wherein the first frangible seal comprises a polymer film membrane and the second frangible seal comprises a non-film polymer material.

14. A hermetic cap according to claim 13, wherein the non-film polymer material is located in the area of the cap immediately surrounding said orifice.

15. A hermetic cap according to claim 13, wherein the non-film polymer material covers substantially the entire inner surface of the cap.

* * * * *